US008071903B2

(12) United States Patent
Sato

(10) Patent No.: US 8,071,903 B2
(45) Date of Patent: Dec. 6, 2011

(54) TRIGGER SWITCH

(75) Inventor: Manabu Sato, Kanagawa (JP)

(73) Assignee: Satori S-Tech Co., Ltd., Tokyo (JP)

( * ) Notice: Subject to any disclaimer, the term of this patent is extended or adjusted under 35 U.S.C. 154(b) by 688 days.

(21) Appl. No.: 12/230,128

(22) Filed: Aug. 25, 2008

(65) Prior Publication Data

US 2009/0057122 A1 Mar. 5, 2009

(30) Foreign Application Priority Data

Aug. 29, 2007 (JP) ..... 2007-222700

(51) Int. Cl.
*H01H 13/02* (2006.01)

(52) U.S. Cl. ..... 200/522

(58) Field of Classification Search ..... 200/520, 200/522, 538, 553–558, 252, 16 A, 16 C, 200/16 R, 6 B, 18
See application file for complete search history.

(56) References Cited

U.S. PATENT DOCUMENTS 7,511,240 B2 * 3/2009 Inagaki et al. ..... 200/522
2006/0186102 A1 * 8/2006 Inagaki et al. ..... 219/130.21

FOREIGN PATENT DOCUMENTS

JP 2003-109451 4/2003

* cited by examiner

*Primary Examiner* — Renee Luebke
*Assistant Examiner* — Marina Fishman
(74) *Attorney, Agent, or Firm* — Wenderoth, Lind & Ponack, L.L.P.

(57) ABSTRACT

A trigger switch has an insulative enclosure, a movable contact element, and a sliding control device slidably mounted to the insulative enclosure. The insulative enclosure includes a case and a cover. The case has plural terminal subassemblies made of conductive metal members disposed therein. The case has an opening over which the cover is mounted. A fixed contact is mounted on one of the terminal subassemblies in the case. The movable contact element has a movable contact mounted at one end of the movable contact element and located opposite to the fixed contact. The movable contact element is swingably supported on another terminal subassembly. A trigger is mounted at one end of the sliding control device. An auxiliary brush is interposed in the movable contact element. A support member is provided with an opening portion in which the auxiliary brush is engaged such that the brush is swingably supported.

4 Claims, 15 Drawing Sheets

TRIGGER SWITCH

BACKGROUND OF THE INVENTION

1. Field of the Invention

The present invention relates to a trigger switch and, more particularly, to improvements in a switch structure inside a trigger switch used in an electric power tool.

2. Prior Art

A conventional and known trigger switch is disclosed, for example, in JP-A-2003-109451. This trigger switch has a control device that is mounted to a case by an improved mounting mechanism. An attempt has been made to reduce the thickness while securing good dustproofness. To achieve this, the state of the switch mechanism inside the case of the trigger switch is switched based on a triggering manipulation. The switch mechanism is incorporated in the internal space of the case. The opening at one side of the case that is opened in a corresponding manner to the internal space of the case is covered and closed by a cover. The control device is accommodated in a concave accommodation portion formed in a part of the other side surface of the case. The other side surface of the case including the outer surface of the control device is covered by a heat-dissipating plate to form an integrated structure.

However, in this conventional trigger switch, when a movable contact element moving swingably is mounted to a support member, the contact element is simply placed on the support member to permit the contact member to swing. Consequently, there is such a problem that the contact element comes off from the support member during use. Furthermore, when the movable contact element moves, the support member tends to bound, producing an arc across the contacted portion. This would produce poor contact. To prevent this, it is necessary to add a brush. However, to hold the brush, a process for tightening the brush is required. This produces a problem that the cost is increased.

Furthermore, as shown in FIG. 26, a trigger 120 is normally molded from resin. Therefore, opening portions are formed only from one direction. Utilizing the opening portions, trigger guide ribs 121 are attached from other components. Therefore, whenever the trigger 120 moves, dust 123 accumulates in the opening portions, 122. The accumulated dust 123 is stored in the interiors of the opening portions 122. The dust stays there without being discharged and interferes with the trigger guide ribs 121. Under this condition, the trigger cannot be pulled to its full stroke, thus presenting a problem.

To permit the trigger to be mounted in an electric power tool easily, the switch itself is required to be integrated with the control device (FET). Therefore, an opening portion is formed in the cover of the switch, and the control device is disposed in the opening portion. In spite of this contrivance, a problem takes place. The movable contact element is received in a position adjacent to the opening portion. Because the opening portion is formed in a part of the cover, dust intruding from the opening portion reaches the chamber of the switch mechanism where the movable contact element is mounted. To prevent this problem, dustproof rubber is used in or around the opening portion in the cover as a dustproof countermeasure. Consequently, intrusion of dust can be prevented. However, there is the problem that dedicated packing or the like is necessary, increasing the cost.

Furthermore, the conventional product has the problem that heat from the FET stays inside the switch because the switch mechanism and the portion accommodating the FET are integrated.

SUMMARY OF THE INVENTION

Accordingly, it is a first object of the present invention to provide a trigger switch in which a movable contact element moving swingably does not easily come off from a support member. Further, it is a second object to provide a trigger switch that permits dust accumulated inside the trigger to be expelled to the outside easily. Further, it is a third object to provide a trigger switch having a cover opening portion to permit a control device to be mounted integrally with a switch, in which dust intruding from the opening portion does not easily intrude into the movable contact element side that is a switch mechanism.

In order to attain the above objects, the present invention provides a trigger switch including: an insulative enclosure including a case and a cover, the case having plural terminal subassemblies made of conductive metal members disposed therein, the case having an opening over which the cover is mounted; a fixed contact mounted on one of the terminal subassemblies in the case; a movable contact element which has a movable contact mounted at one end of the movable contact element and located opposite to the fixed contact and is swingably supported on another terminal subassembly; and a sliding control device which has a trigger mounted at one end of the sliding control device and is slidably mounted to the insulative enclosure, wherein the movable contact element is swingably supported on a support member in a state that an auxiliary brush interposed therebetween and the auxiliary brush is engaged with an opening provided on the support member.

Preferably, the trigger has trigger guide ribs for guiding sliding motion of the trigger, rib engagement portions in which the trigger guide ribs are inserted, and opening portions formed in the rib engagement portions to permit dust to be expelled.

Another trigger switch according to the present invention switches the state of a switch mechanism mounted inside a case based on a sliding manipulation of a trigger. A control device is disposed under the condition where the control device is exposed from the outer wall surface of a cover that covers the case. Dustproof walls are mounted between a first chamber where the control device is disposed and a second chamber constituting the switch mechanism to keep out dust.

A further trigger switch according to the present invention switches the state of a switch mechanism mounted inside a case based on a sliding manipulation of a trigger. The trigger has trigger guide ribs for guiding sliding motion of the trigger, rib engagement portions in which the trigger guide ribs are inserted, and opening portions formed in the rib engagement portions to permit dust to be expelled.

In the present invention, the auxiliary brush is interposed in the movable contact element moving swingably. The auxiliary brush is engaged in the opening portion formed in the support member. The movable contact elements are supported swingably. The movable contact elements do not easily come off from the support member during assembly and during use. It is assured that the movable contact elements swing stably. During swinging motion, the movable contact elements are prevented from bounding; otherwise, an are would be induced across the contacted portion and poor contact would be made.

The trigger has a space in addition to the opening portions in which ribs are engaged. The space is formed in bottom and top portions and in communication with the opening portions. Therefore, dust produced when the ribs are engaged in the opening portions can be expelled to the outside via the space in communication with the opening portions. Consequently, accumulation of dust inside the bigger can be avoided. The problem that the trigger cannot be pulled to its full stroke can be prevented.

In addition, an opening portion is formed to permit a control device mounted in the cover to be opened. Dustproof walls are mounted at a position located on one side of the opening portion. In consequence, dust intruding from the opening portion can be prevented from intruding to the switch mechanism side.

Yet further, the switch mechanism and the FET accommodation portions are made independent of each other. Consequently, the switch mechanism can be prevented from being affected by heat generated from the FET.

DETAILED DESCRIPTION OF THE PREFERRED EMBODIMENTS

Trigger switches according to embodiments of the present invention are hereinafter described in detail with reference to the drawings.

Figure 1:
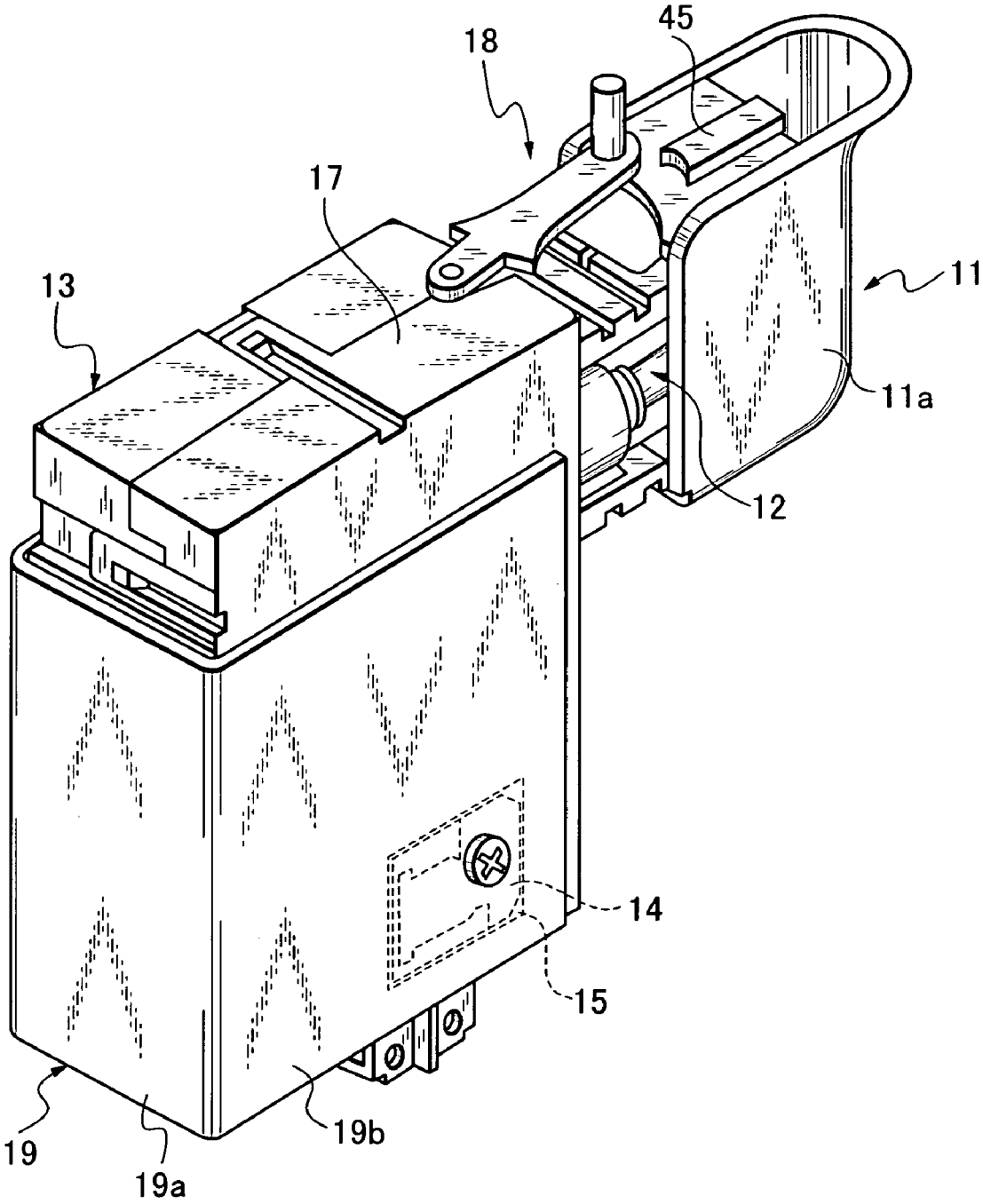
FIG. 1 is a perspective view of a trigger switch according to one embodiment of the present invention, showing the appearance as viewed from the front side.
Figure 2:
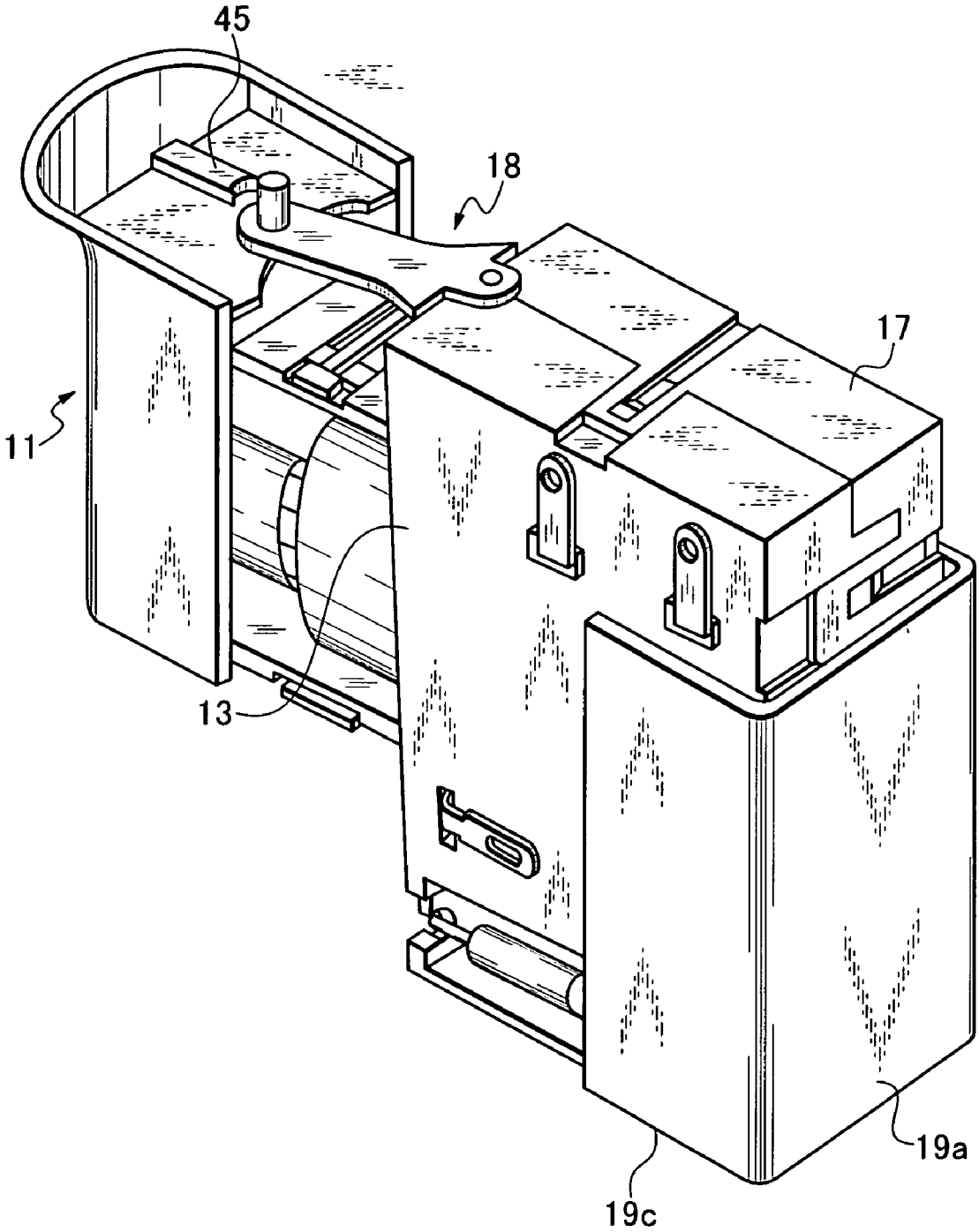
FIG. 2 is a perspective view of the trigger switch, showing the appearance as viewed from the rear side.
Figure 3:
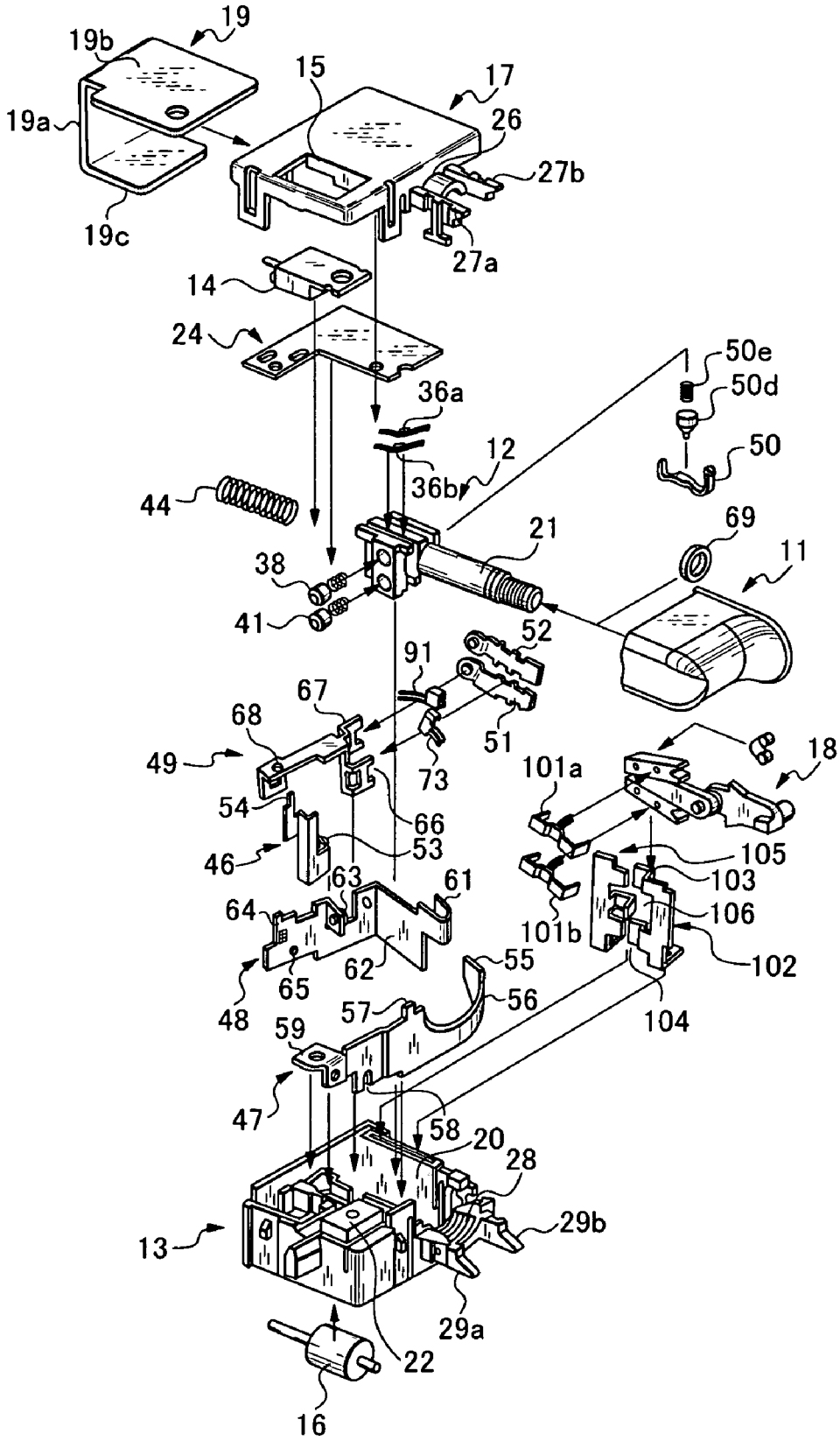
FIG. 3 is an exploded perspective view of the trigger switch.

A trigger switch according to an embodiment of the present invention is shown in FIGS. 1, 2, and 3. The trigger switch has a vertically elongated box-like form, and has a case 13, a cover 17, a bigger 11 capable of being manipulated by hand fingers, a switching control portion 18 mounted on the top surface of the case 13 and acting to switch the direction of the rotation of a motor, and a heat-dissipating plate 19 disposed at the position of the outer periphery of the cover 17 mounted over the case 13. A sliding control device 12 for transferring an external manipulating action from the trigger 11 is mounted at a higher position in the case 13, which has an open side surface. A switch mechanism is incorporated in the case 13. The cover 17 doses the open surface at the side of the case 13 and has an open portion 15 to cause a control device (FET) 14 to be exposed to the outside.

Figure 4:
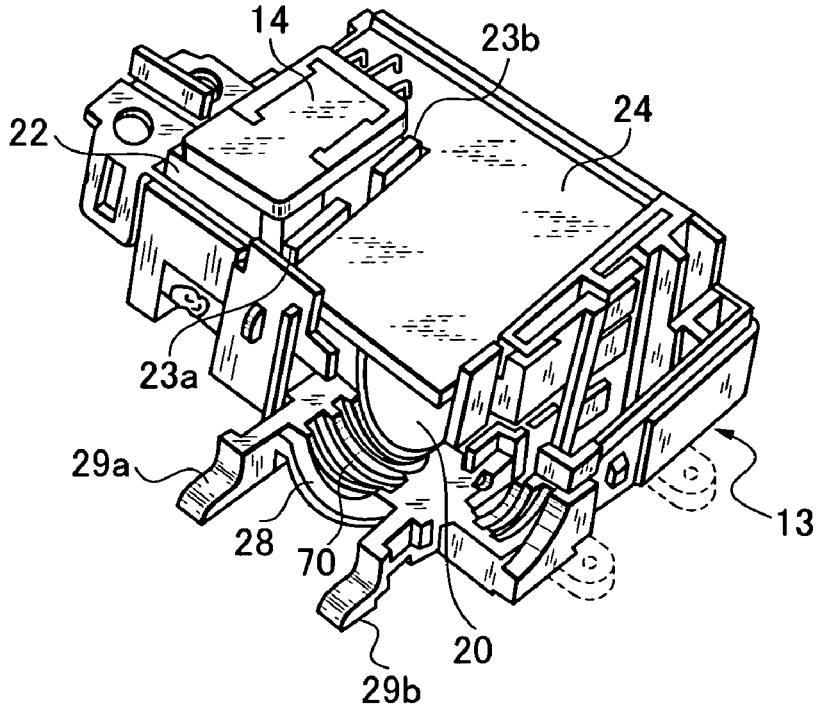
FIG. 4 is a perspective view of a case of the trigger switch.

As shown in FIGS. 3 and 4, the case 13 has a switch chamber 20 as a second chamber and a device placement portion 22 as a first chamber on which the control device 14 is placed. The switch chamber 20 has one open side. The switch mechanism is mounted in the switch chamber 20. Two linear protrusive dustproof walls, or first dustproof wall 23*a* and second dustproof wall 23*b*, are mounted on the boundary line between the device placement portion 22 and the switch chamber 20. The side surface in communication with the switch chamber 20 is provided with a coaxial engagement hole 28 in the form of an incomplete cylinder. The sliding control device 12 has a sliding shaft 21 engaged in the coaxial engagement hole 28. Protrusive trigger guide ribs 29*a* and 29*b* are mounted at higher and lower positions, respectively, of the coaxial engagement hole 28. A sliding circuit board 24 is placed from above the switch chamber 20, and the control device (FET) 14 is placed on the device placement portion 22. Thus, the bigger switch is assembled.

Figure 5:
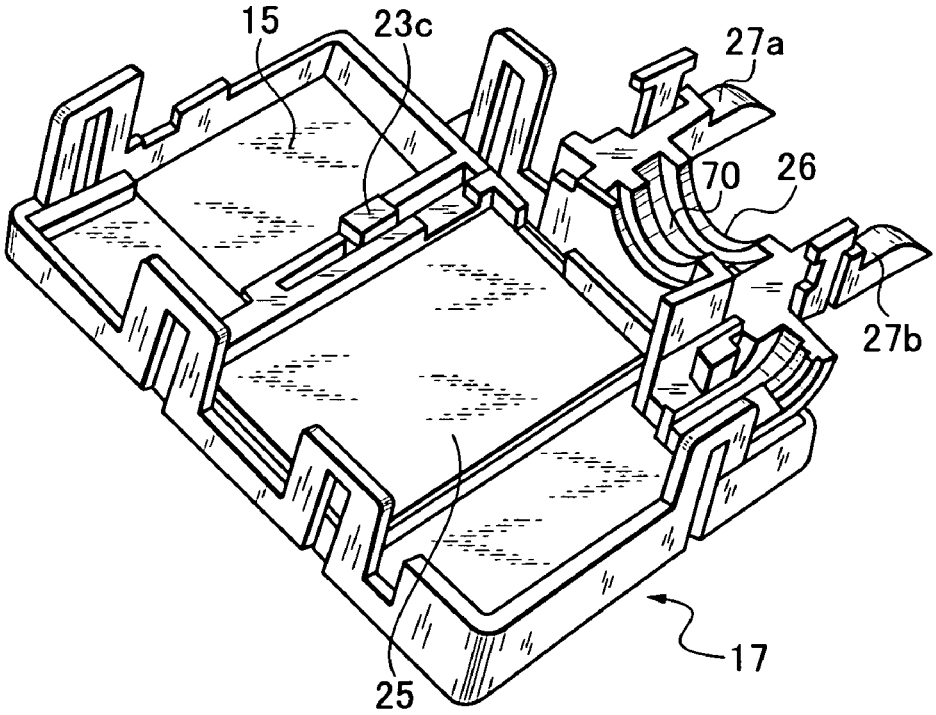
FIG. 5 is a perspective view of a cover of the bigger switch.

As shown in FIGS. 3 and 5, the cover 17 plugs the opening at the side face of the case 13 and has the open cutout portion 15 for exposing the control device (FET) 14 equipped in the case 13. The cover 17 has a cover portion 25 covering over the sliding circuit board 24. A third dustproof wall 23*c* inserted between the first dustproof wall 23*a* and the second dustproof wall 23*b* is formed on the boundary line between the open portion 15 and the cover portion 25. The first and second walls 23*a* and 23*b* are present in the case 13.

The cover 17 constructed in this way is placed over the above-described case 13 in such a way that the third dustproof wall 23*c* is inserted between the first dustproof wall 23*a* and the second dustproof wall 23*b*. This can eliminate any gap in the region extending from the region of the placed FET 14 to the region of the switch chamber 20. Consequently, a dustproof wall can be provided to prevent intrusion of dust into the FET 14 that is in an open state. Intrusion of dust into the switch chamber 20 can be prevented. Furthermore, heat generated by the FET 14 can be shielded by mounting the first through third dustproof wails 23*a*, 23*b*, 23*c* between the device placement portion 22 on which the FET 14 is placed and the switch chamber 20. Effects of heat on the switch chamber 20 can be avoided.

A coaxial engagement hole 26 in the form of an incomplete cylinder is formed in an upper position within the cover portion 25. The sliding shaft 21 of the sliding control device 12 is engaged in the engagement hole 26. Protrusive trigger guide ribs 27*a* and 27*b* are mounted and arranged vertically symmetrically with respect to the coaxial engagement hole 26. The surface of the FET 14 disposed so as to face the open portion 15 is made flush with the sidewall surface of the cover 17. That is, when the heat-dissipating plate 19 is mounted while the FET 14 is made to face the open portion 15, the surface of the FET 14 can be brought into direct contact with the inner wall surface of the heat-dissipating plate 19.

The heat-dissipating plate 19 shown in FIGS. 1, 2, and 3 is shaped to cover both the sidewall surface of the cover 17 and the sidewall surface of the case 13. One surface 19*b* connected to a connecting portion 19*a* is in direct contact with the surface of the device of the FET 14 accommodated in the case. The other surface 19*c* connected to the connecting portion 19*a* is sized to cover the sidewall surface of the case 13. Heat from the surface 19*b* in direct contact with the FET 14 is directly diffused to the surface 19*b* that covers the cover 17 and, at the same time, is diffused via the connecting portion 19*a* to the surface 19*c* that covers the sidewall surface of the case 13. Consequently, heat generated from the FET 14 can be dissipated away uniformly.

Figure 6:
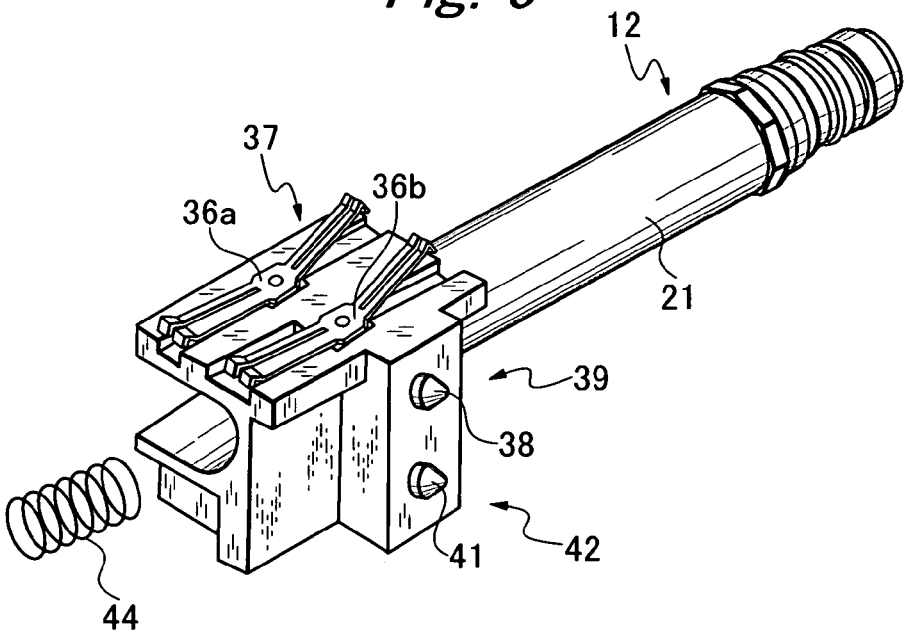
FIG. 6 is a perspective view of a sliding control device incorporated in the trigger switch.
Figure 7:
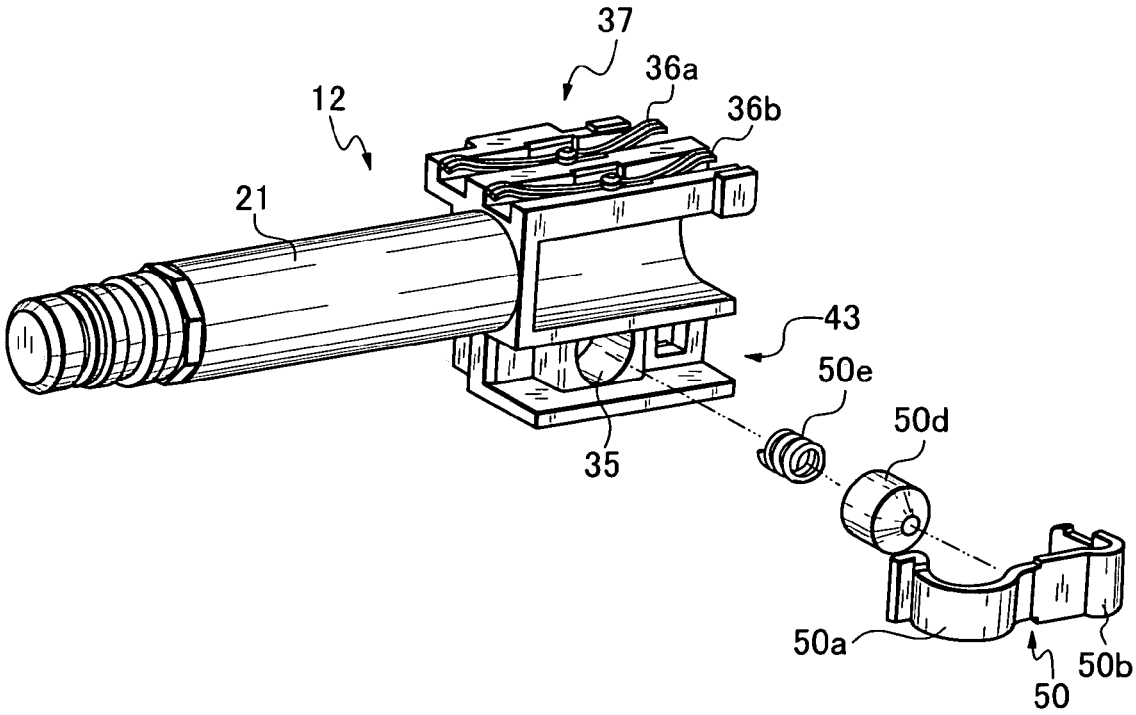
FIG. 7 is a perspective view of the sliding control device, as viewed from the rear side.
Figure 8:
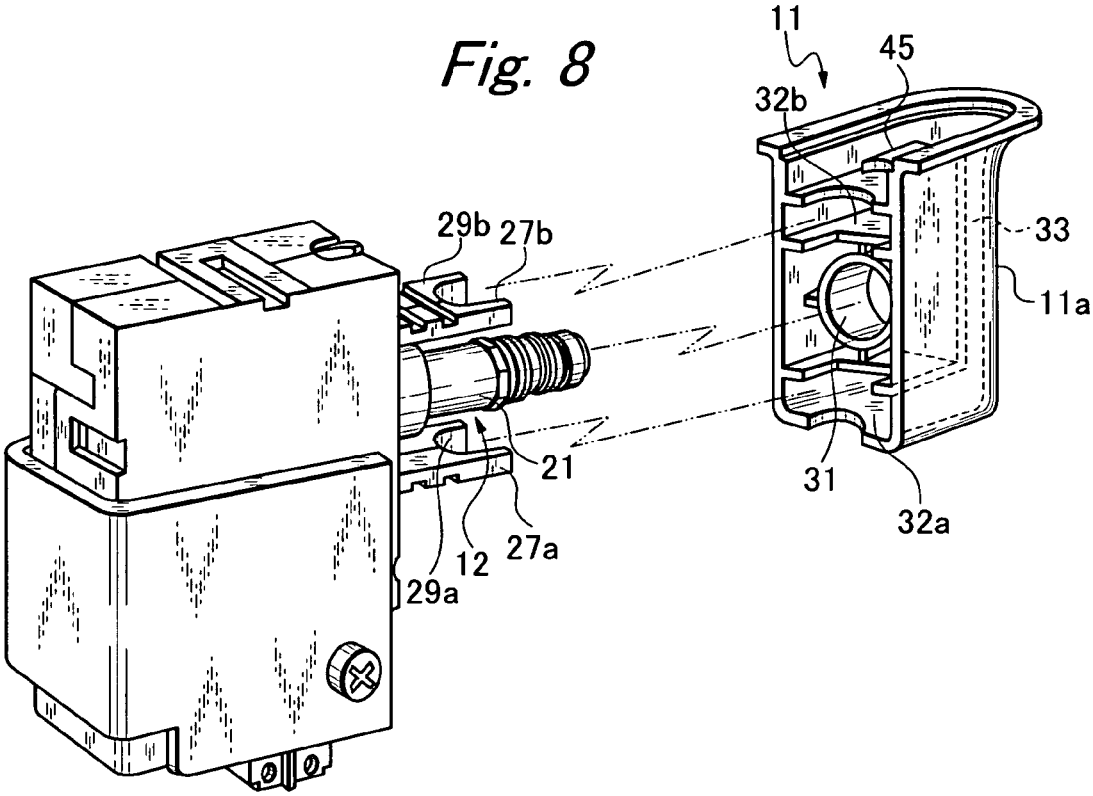
FIG. 8 is a perspective view of the trigger switch, and in which the trigger has been separated from the bigger switch.

As shown in FIGS. 3, 6, and 7, the sliding control device 12 has a so-called switch mechanism. The sliding control device can implement four functions of supplying electric power to the motor in response to a manipulation of the trigger 11, controlling the speed of the motor according to the manipulating degree of the trigger 11, electrically shorting the power supply for the motor and supplying electric power to the motor in response to the manipulating degree of the trigger 11, and electrically shorting the motor when the motor is at rest, in one sliding operation. These structures will be described later.

As shown in FIGS. 3, 8, 9, and 10, the trigger 11 is formed in a semi-elliptic columnar shape, and has a sidewall having a handle portion 11*a*. The trigger has an axial engagement portion 31 on the opposite side of the handle portion 11*a*. The sliding shaft 21 of the sliding control device 12 engages the axial engagement portion 31. Rib engagement portions 32*a* and 32*b* are formed on the lower and upper sides, respectively, of the axial engagement portion 31. The rib engagement portions 32*a* and 32*b* are made of hollow cavities in which the trigger guide ribs 29*a*, 27*a* and 29*b*, 27*b* for guiding motion of the trigger can be accommodated. The trigger has an opening portion 33 located on the side of the handle portion 11a in communication with the rib engagement portions 32*a* and 32*b*. The opening portion 33 has a hollow interior and an open upper end. A trigger stopper portion 45 shaped like a rectangular parallelepiped is formed at the top of the trigger 11. When the switching control portion 18 is in its neutral position, the trigger stopper portion 45 inhibits the trigger 11 from being pulled in.

Figure 9:
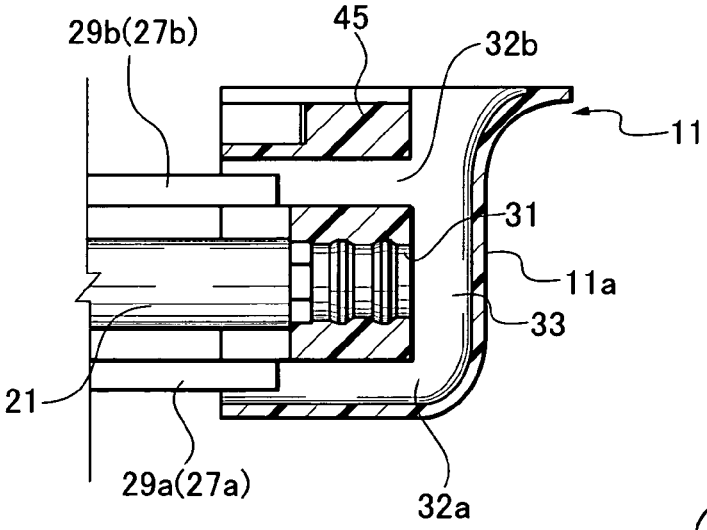
FIG. 9 is a vertical cross section of the trigger.

The trigger 11 constructed in this way has a function of guiding motion of the trigger 11 by bringing the front side of the sliding shaft 21 of the sliding control device 12 into fitting engagement with the axial engagement portion 31 and, at the same time, causes the trigger guide ribs 29*a*, 29*b* and 27*a*, 27*b* to be received in the rib engagement portions 32*a* and 32*b*, respectively. The trigger guide ribs 29*a*, 29*b*, 27*a*, and 27*b* are brought into engagement with the rib engagement portions 32*a*, 32*b* by placing the upper trigger guide ribs 27*b* and 29*b* above the upper end of the rib engagement portion 32*b* with gaps therebetween as shown in FIG. 9 and placing the lower trigger guide ribs 27*a* and 29*a* under the lower end of the rib engagement portion 32*a* with gaps therebetween.

Figure 10:
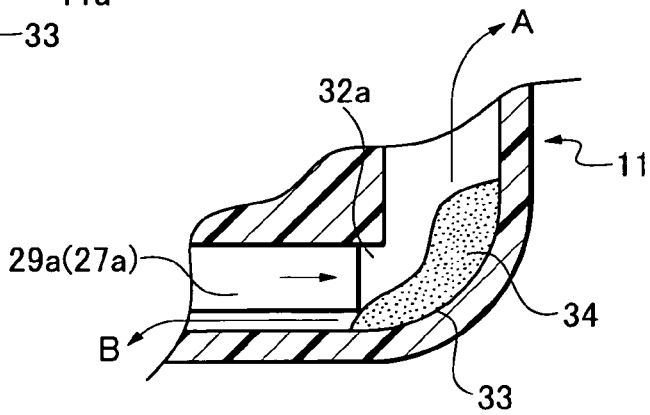
FIG. 10 is a partially enlarged vertical cross section of the trigger.

When the trigger 11 constructed in this way is brought into engagement with the sliding shaft 21 and a manipulation is performed while holding the handle portion 11*a* on one hand, dust 34 accumulated inside the trigger 11 is accumulated within the opening portion 33 when a machine tool is being used as shown in FIG. 10. When the trigger guide ribs 27*a* and 29*a* are moved rearward along the rib engagement portion 32*a* by manipulation of the trigger 11, the dust 34 accumulated in the opening portion 33 is expelled to the outside from the opening position (in the direction indicated by the arrow A) at the upper end of the opening portion 33 or expelled toward the body side (in the direction indicated by the arrow B) along the gaps in the rib engagement portion 32*a* with which the trigger guide ribs 27*a* and 29*a* are in engagement.

Dust accumulated when the trigger 11 is being used is expelled to the outside of the trigger 11 by making use of motion of the trigger guide ribs 27*a* and 29*a* in this way. Consequently, incorrect operation of the trigger 11 due to dust accumulated in the trigger 11 can be prevented.

As shown in FIGS. 3, 6, and 7, the sliding control device 12 has the sliding shaft 21 shaped like a rod, a velocity control portion 37 located on the base side of the sliding shaft 21 and acting to control the rotational velocity of a motor, a control device-shorting portion 39 mounted to the velocity control portion 37, a power-supply control portion 42 having a sliding knob 41 sliding on the movable contact element for supplying electric power to the FET that controls the motor, the knob 41 being juxtaposed to the control device-shorting portion 39, and a motor-shorting portion 43 (see FIG. 7) on the base side of the sliding shaft 21 on the opposite side of the power-supply control portion 42. The sliding shaft 21 has a free end to which the trigger 11 can be mounted. The velocity control portion 37 has two sliders 36*a* and 36*b* disposed parallel to the top surface of the trigger. The control device-shorting portion 39 has a sliding knob 38 sliding on a movable contact element for electrically shorting the control device to a sidewall. The motor-shorting portion 43 electrically shorts the motor to brake it.

The motor-shorting portion 43 has a sliding knob 50*d* and a motor-shorting terminal subassembly 50. The knob 50*d* is engaged in an engagement hole 35 via a spring 50*e*. The motor-shorting terminal subassembly 50 is cantilevered over the sliding knob 50*d*.

The terminal subassemblies made of conductive metal members and activated by the speed control portion 37, control device-shorting portion 39, power-supply control portion 42, and motor-shorting circuit 43 are composed of 7 contact components, i.e., a motor driver terminal subassembly 46, a positive power supply terminal subassembly 47, a control device-shorting terminal subassembly 48, a negative power supply terminal subassembly 49, the motor-shorting terminal subassembly 50, a first movable contact element 51, and a second movable contact element 52 as shown in FIG. 3.

Figure 11A:
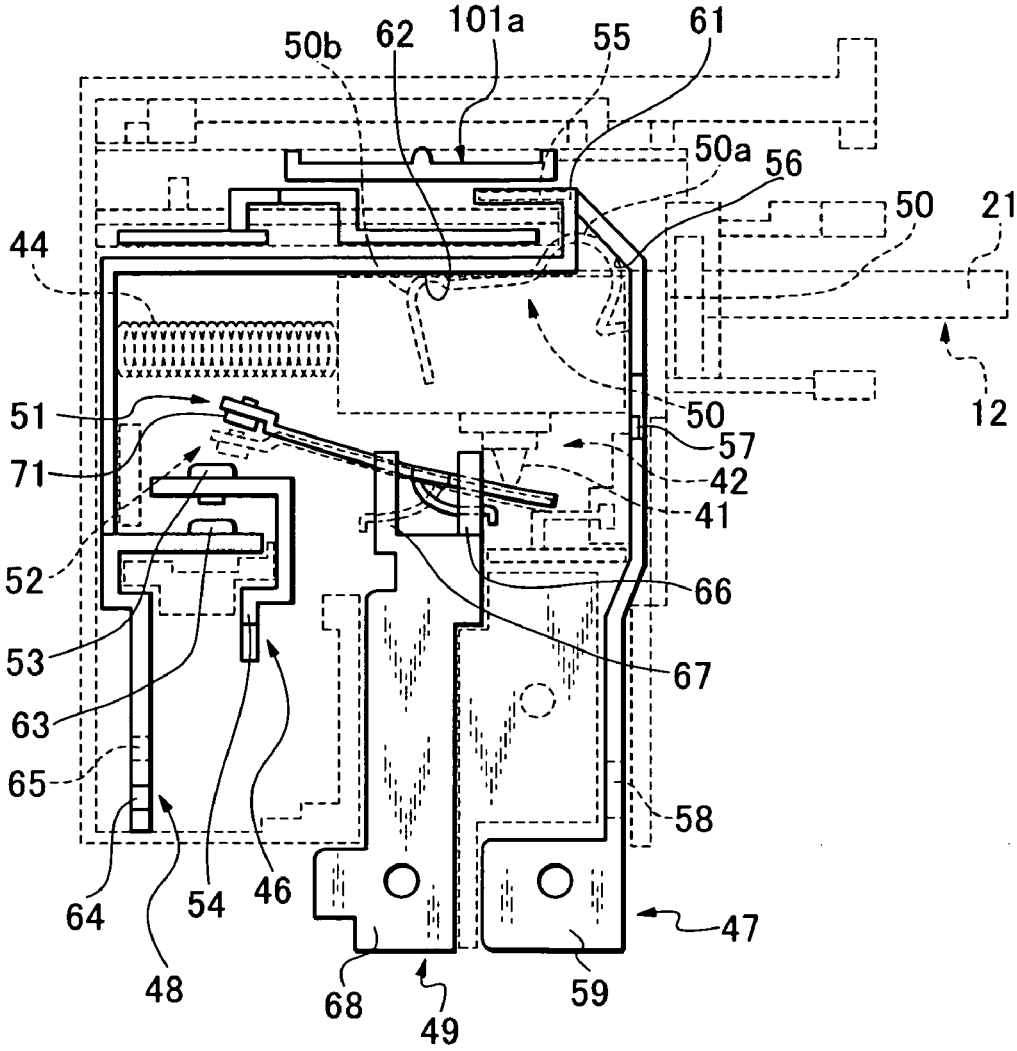
FIG. 11A is a side elevation of the bigger switch, showing the manner in which terminal subassemblies are assembled.

As shown in FIGS. 3 and 11A, the motor driver terminal subassembly 46 has a first contact 53 fabricated by bending a lower portion of a flat plate member. The first contact 53 makes contact with the contact portion of the first movable contact element 51. The driver terminal subassembly 46 has an FET contact portion 54 at a higher position. The FET contact portion 54 is connected with the source side of the FET on the sliding circuit board 24.

As shown in FIGS. 3 and 11A, the positive power supply terminal subassembly 47 has a first switching contact 55, out of contacts switched by the switching control portion 18, which is made of an elongated conductive member having a top portion bent into a tongue-like shape. Furthermore, the terminal subassembly 47 has a first shorting portion 56, which is bent at a position lower than the first switching contact 55, and a convex portion 57, which is located at a higher position of the first shorting portion 56 and engages the sliding circuit board 24. In addition, the terminal subassembly 47 has a diode connection portion 58 for connection with a diode 16. The diode connection portion 58 is split into two and made to protrude away from the convex portion 57 below the convex portion 57. Additionally, the terminal subassembly 47 has a terminal portion 59 at its lower end, the terminal portion 59 being for use for connection with the positive power supply.

As shown in FIGS. 3 and 11A, the control device-shorting terminal subassembly 48 has a tongue-like second switching contact 61 out of the contacts switched by the switching control portion 18. The tongue-like second switching contact 61 is fabricated by bending a flat plate member at right angles and bending the bent end portion through about 180 degrees outwardly. In addition, the control device-shorting terminal subassembly 48 has a second shorting portion 62 in the form of a flat plate, a second contact element 63 making contact with the contact portion of the second movable contact element 52, an FET contact portion 64 located below and on the upstream side of the second contact element 63, and a diode connection portion 65 located on the opposite side of the FET contact portion 64. The second shorting portion 62 is located on the base side and forms the second switching contact element 61. The second contact element 63 is fabricated by bending a substantially central portion of the perpendicularly bent portion on the opposite side and cutting out the central portion. The second contact element 63 electrically shorts and energizes the drain and source of the FET. The FET connection portion 64 is connected with the drain of the FET 14. The diode connection portion 65 is used for connection with the diode 16.

As shown in FIGS. 3 and 11A, the negative power supply terminal subassembly 49 has a first movable contact element support portion 66, a second movable contact element support portion 67 disposed on the opposite side of the first movable contact element support portion 66 and spaced from it by a distance equal to the width of the flat plate member, and a negative terminal portion 68 for connection with a negative power supply. The first movable contact element support portion 66 is fabricated by bending an upper portion of an elongated flat plate member perpendicularly. The first movable contact element 51 is swingably placed on the bent flat plate member of the first movable contact element support portion 66. The second movable contact element 52 is swingably placed on the second movable contact element support portion 67. The negative terminal portion 68 is located at the opposite end.

As shown in FIGS. 3, 7, and 11A, the motor-shorting terminal subassembly 50 is disposed on the opposite side of the velocity control portion 37 of the sliding control device 12. When the control device 12 is biased outwardly by the biasing force of a return spring 44, the shorting terminal subassembly 50 electrically connects the first shorting portion 56 of the positive power supply terminal subassembly 47 and the second shorting portion 62 of the control device-shorting terminal subassembly 48 so that the electrodes of the motor are electrically shorted to each other. Thus, the motor is braked. The shorting terminal subassembly 50 is made up of a first contact portion 50*a* fabricated by arcuately shaping one end portion of a metallic flat plate member, a second contact portion 50*b* fabricated by arcuately shaping other end portion, and an engagement portion 50*c* fabricated by bending an end portion of the arcuately shaped portion in an outward direction.

The five contact elements shaped as mentioned above are accommodated in the case 13. First, as shown in FIG. 11A, the motor driver terminal subassembly 46 is inserted and mounted in the central position of the bottom of the space forming a switch mechanism as viewed from the opening of the case 13. Then, the positive power supply terminal subassembly 47 is mounted to the front wall surface on the side of the sliding shaft 21 mounted to the case 13. The control device-shorting terminal subassembly 48 is mounted to the rear wall surface of the case 13. Finally, the negative power supply terminal subassembly 49 to which the first and second movable contact elements 51 and 52 have been mounted is mounted substantially in the center position of the case 13.

Referring back to FIGS. 3, 4 and 5, the sliding shaft 21 is engaged in the coaxial engagement holes 26 and 28 formed by the case 13 and cover 17. A packing accommodation portion 70 in which packing 69 is accommodated is formed in the coaxial engagement holes 26 and 28.

As shown in FIG. 11A, in the power-supply control portion 42, the sliding knob 41 slides on the surface of the first movable contact element 51 in response to the degree of pushing motion of the sliding shaft 21 of the sliding control device 12. The contact on the sliding knob is brought into contact with the first contact 53, thus supplying electric power to the motor. As shown in FIGS. 11A, 16, 17, and 18, the first movable contact element 51 is made of an elongated conductive flat plate member. A movable contact 71 for supplying electric power is formed at one end of the elongated conductive plate member. A concave engagement portion 72 is formed at a widthwise end in a substantially central position. The first movable contact element support portion 66 has a placement portion 66*a* with which the engagement portion 72 engages. An auxiliary brush engagement portion 74 with which an auxiliary brush 73 engages is formed behind the engagement portion 72.

The first movable contact element 51 constructed as described so far does not easily come off when it engages the first movable contact element support portion 66 by attaching the auxiliary brush 73. The rear surface of the first movable contact element 51 is aligned with the position of the placement portion 66*a* of the first movable contact element support portion 66 equipped in the negative power supply terminal subassembly 49. The auxiliary brush 73 has a small spring 76 that is inserted and mounted in the opening portion 66*b*. The auxiliary brush 73 inhibits the first movable contact element support portion 66 and first movable contact element 51 from bounding and prevents poor contact. In an OFF state, the movable contact 71 of the first movable contact element 51 is located opposite to the first contact 53 of the motor driver terminal subassembly 46 placed in the case 13 (see FIG. 11A).

Figure 11B:
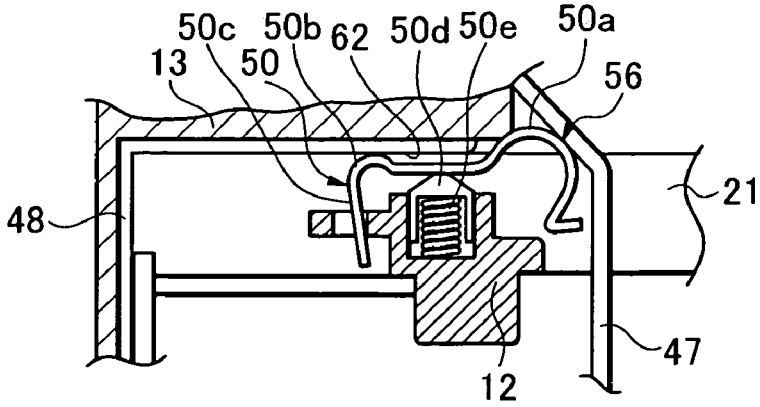
FIG. 11B is a partially enlarged vertical cross section of the trigger switch, illustrating operation of the sliding control device.

The first movable contact element 51 is disposed in this way. The sliding knob 41 (see FIGS. 11A and 11B) of the sliding control device 12 is placed on the top surface of the disposed first movable contact element 51. A spring is incorporated in the sliding knob 41 and so the knob is kept biased. That is, when the sliding knob 41 is placed on the top surface of the first movable contact element 51, the knob 41 biases the top surface of the first movable contact element 51. As shown in FIGS. 11A and 11B, when the sliding control device 12 is not operated, the first movable contact element 51 is pushed in by the return spring 44. Therefore, the position of the sliding knob 41 is at the rearward end as viewed in FIG. 11A on the right side of the first movable contact element support portion 66 about which the first movable contact element 51 is seesawed. The movable contact 71 is raised upward and spaced from the first contact 53.

At this time, the first contact portion 50*a* of the motor-shorting terminal subassembly 50 of the motor-shorting portion 43 mounted at a lower position in the sliding control device 12 is in contact and connected with the first shorting portion 56 of the positive power supply terminal subassembly 47. The second shorting portion 62 of the control device-shorting terminal subassembly 48 and the second contact portion 50*b* of the motor-shorting terminal subassembly 50 are connected. The motor is electrically shorted and thus supply of electric power to the motor is cut off.

Figure 12A:
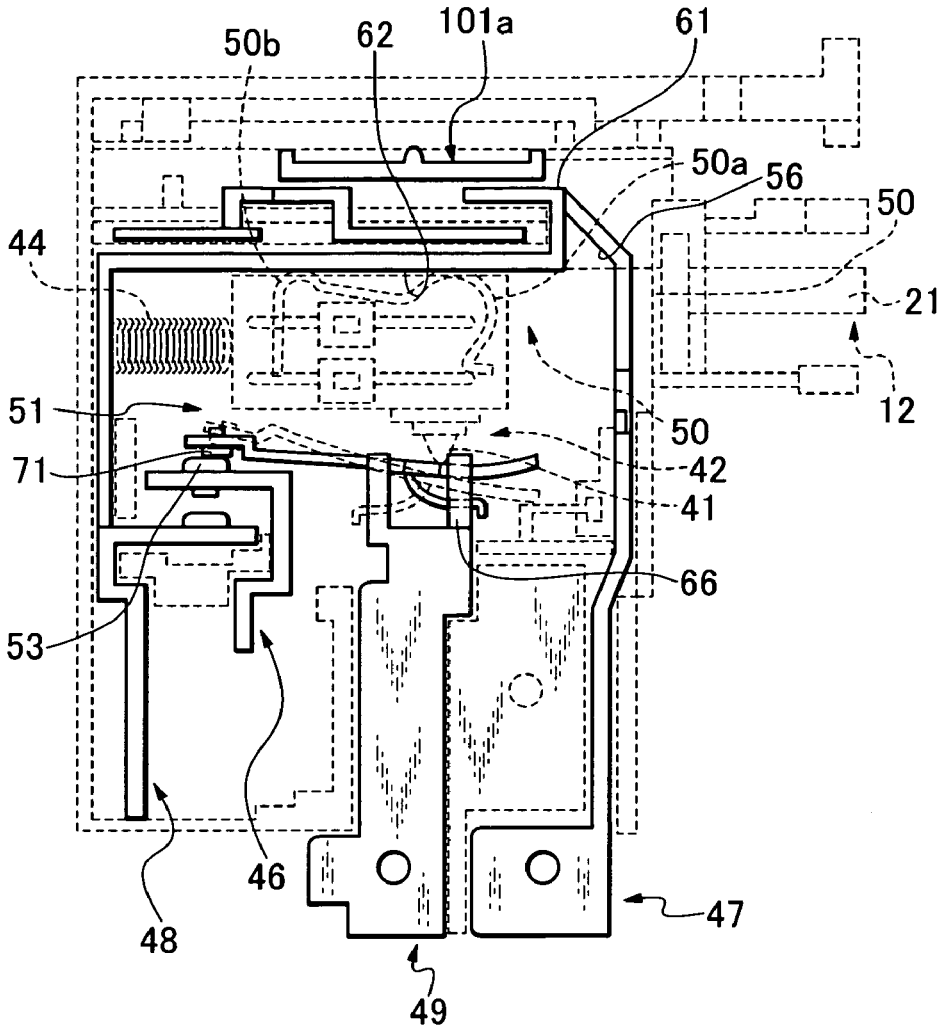
FIG. 12A is a side elevation of the trigger switch, showing the manner in which the terminal subassemblies are assembled.
Figure 12B:
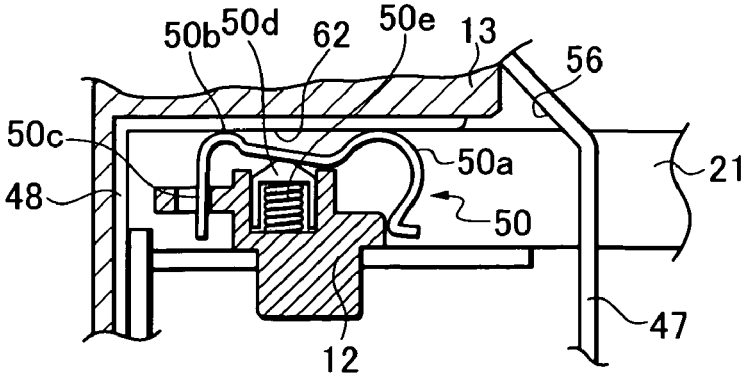
FIG. 12B is a partially enlarged vertical cross section of the trigger switch, illustrating operation of the sliding control device.

Under this condition, if the sliding control device 12 is pulled in, the sliding shaft 21 operates to move the first contact portion 50*a* of the motor-shorting terminal subassembly 50 of the motor-shorting portion 43 mounted at a lower position in the sliding control device 12 away from the first shorting portion 56 of the positive power supply terminal subassembly 47 as shown in FIGS. 12A and 12B. Both of the first contact portion 50*a* and the second contact portion 50*b* are in contact and connected with the second shorting portion 62 of the control device-shorting terminal subassembly 48. Because the first contact portion 50*a* is moved away from the first shorting portion 56, supply of electric power to the motor is enabled. The sliding knob 41 that is a push member interlocking with the sliding shaft 21 slides on the top surface of the first movable contact element 51 and moves toward the movable contact 71. When the sliding knob 41 goes across the first movable contact element support portion 66 of the negative terminal 40, the first movable contact element 51 is returned in the horizontal direction. The movable contact 71 is brought into contact with the first contact 53. This makes preparations for supply of electric power to the motor (not shown). Then, the rotational speed of the motor is controlled under control of the velocity control portion 37.

As shown in FIGS. 3, 6, 7, 13, and 15, the velocity control portion 37 consists roughly of two juxtaposed sliders 36*a* and 36*b* connected to the sliding control device 12 and a sliding circuit board 24 (see FIG. 15) having sliding contact elements 81, 82, 83, and 84 making resilient contact with the sliders 36*a* and 36*b* that interlock with the sliding control device 12.

The sliding circuit board 24 has circuit elements on its front surface. The sliding circuit board 24 has sliding contact elements 81, 82, 83, and 84 on its rear surface. The contact elements 81-84 make sliding contact with the sliders 36*a* and 36*b*. Each of the sliders 36*a* and 36*b* is a conductive and elongated flat plate member and bifurcated on each side to form side end portions each of which is shaped arcuately as a whole. A front-end portion of each side end portion is bent upward and then bent downward to form a contact. A hole is formed in the center of the contact. A boss protruding from the base portion is engaged in this hole.

In the velocity control portion 37 constructed in this way, when the sliding control device 12 is manipulated by the trigger 11 against the action of the return spring 44, the sliders 36*a* and 36*b* come into contact with the sliding contact elements 81, 82, 83, and 84 of the sliding circuit board 24. The degree of contact is controlled such that the rate of rotation of the motor is controlled from 0% to about 100% in relation to the state of the power switch (i.e., ON or OFF) of the power-supply control portion 42. When the rate of rotation of the motor is about 100%, the control device-shorting portion 39 operates to control the motor to its shorted state. Consequently, about 100% of electric power is supplied to the motor.

Figure 13:
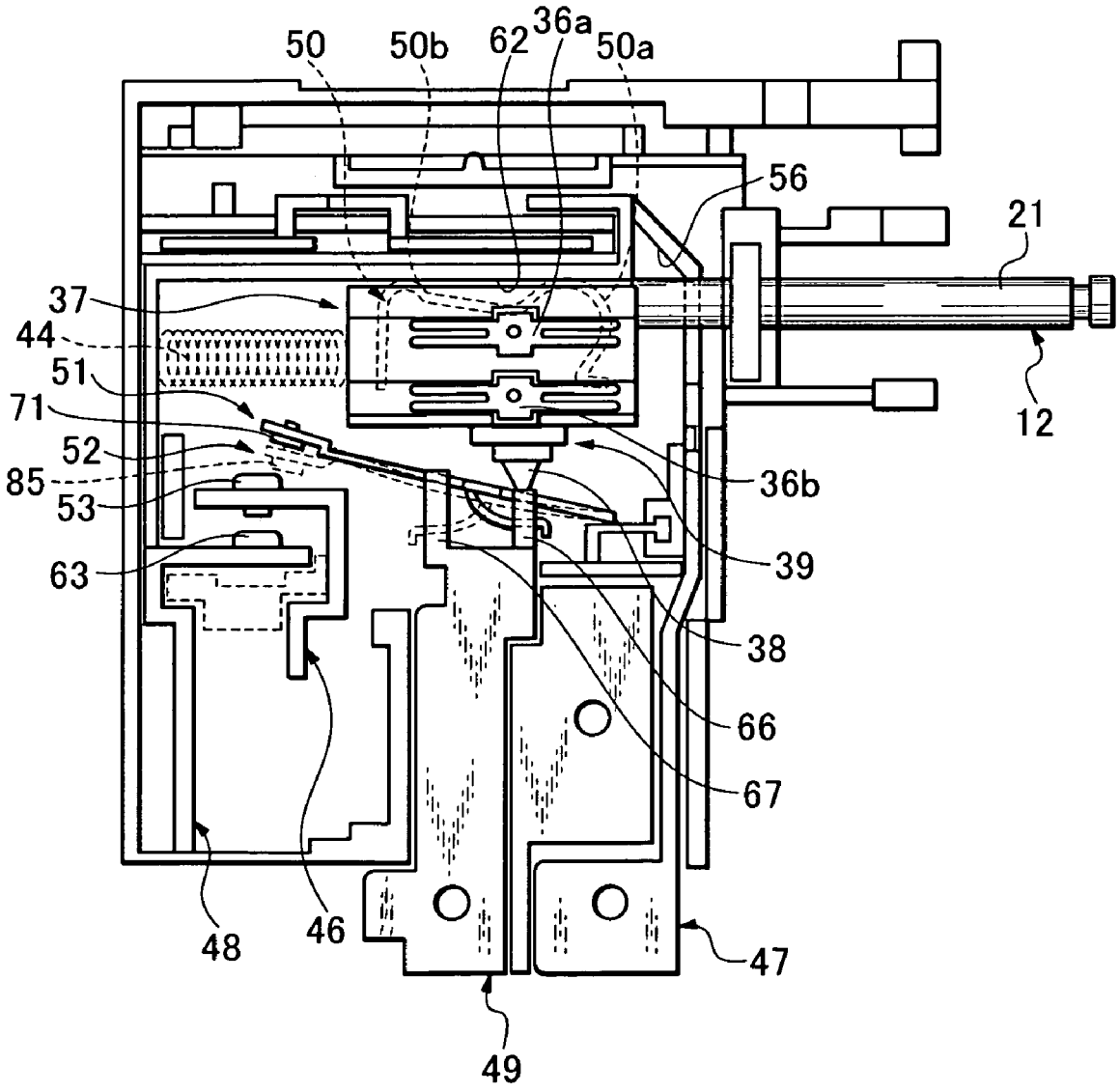
FIG. 13 is a side elevation of a support portion of the trigger switch, and in which the support portion with which a second movable contact element engages has been extracted.
Figure 14:
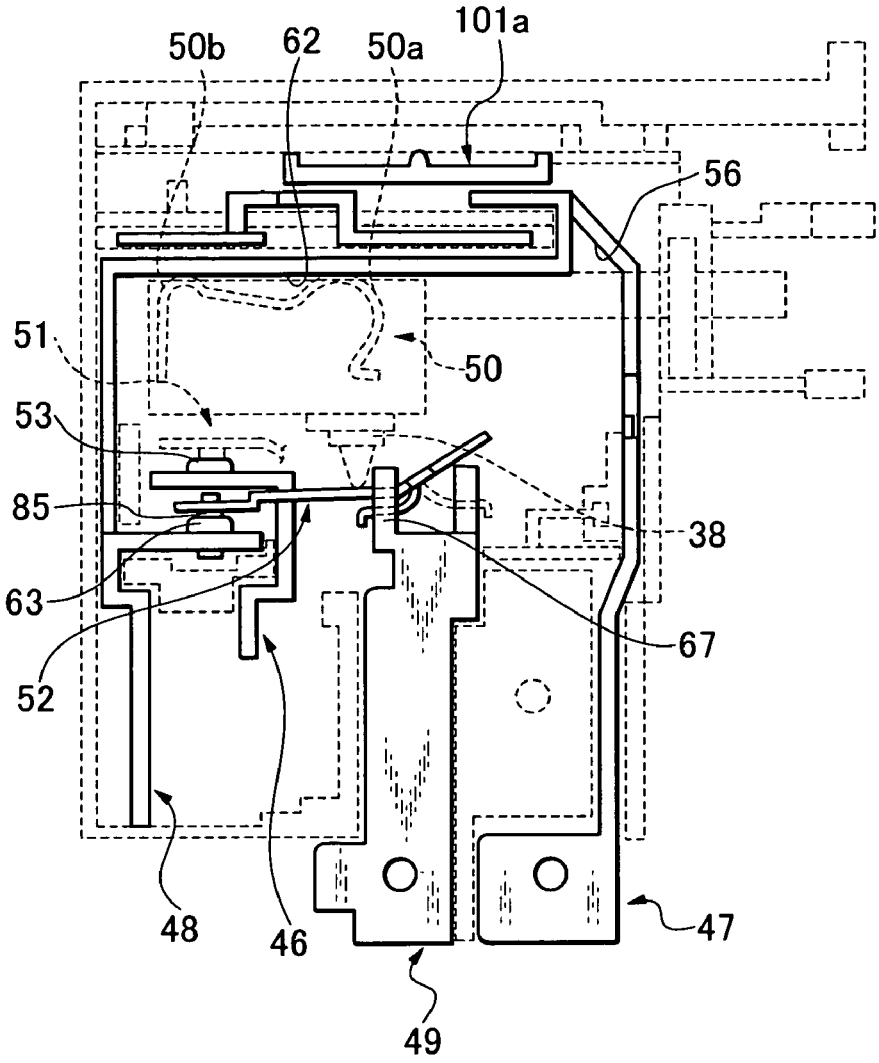
FIG. 14 is a side elevation of the trigger switch, and in which the second movable contact element is activated.
Figure 15:
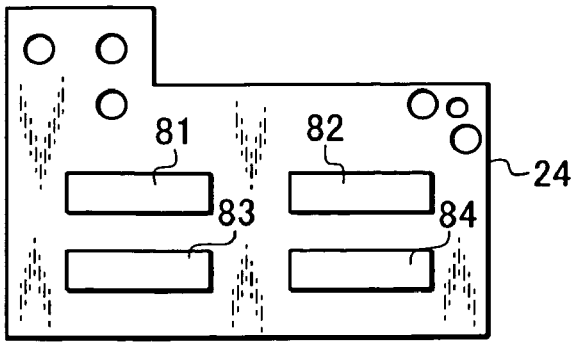
FIG. 15 is a plan view of a sliding circuit board of the bigger switch.
Figure 16:
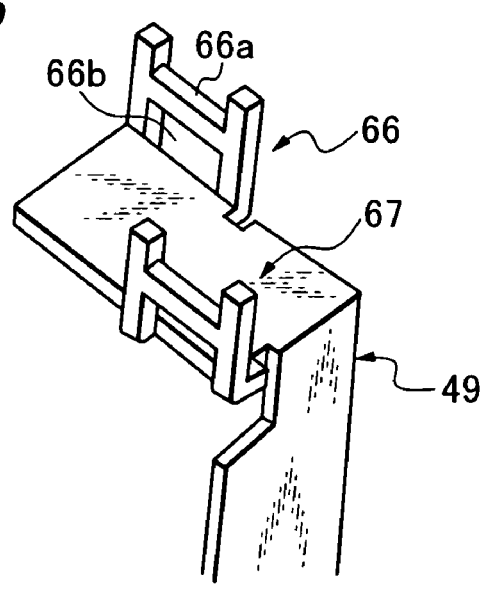
FIG. 16 is a perspective view of support portions of the trigger switch that support the first and second movable contact elements.
Figure 17:
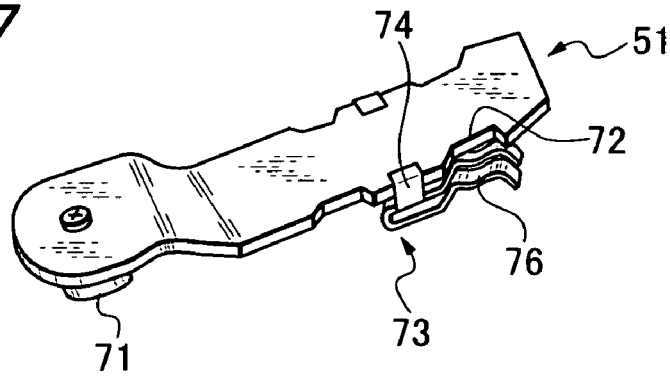
FIG. 17 is a perspective view of the first movable contact element.
Figure 18:
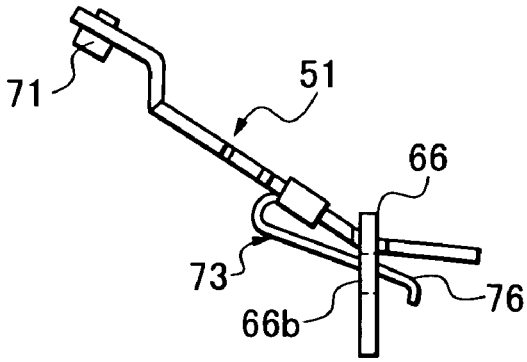
FIG. 18 is a side elevation of the first movable contact element and its support portion.
Figure 19:
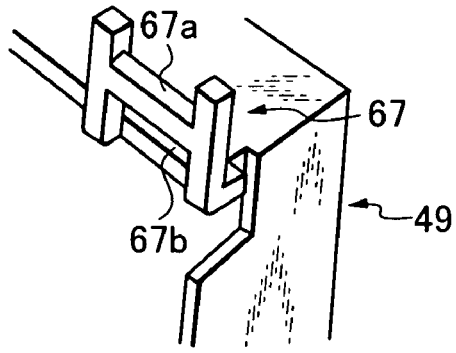
FIG. 19 is a perspective view of parts of a support portion for the second movable contact element.
Figure 20:
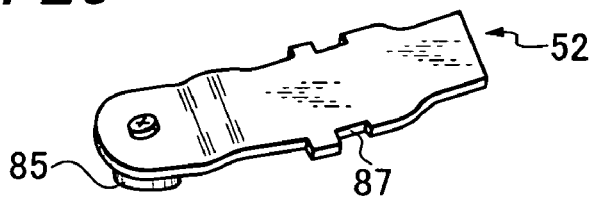
FIG. 20 is a perspective view of the second movable contact element of the trigger switch.
Figure 21:
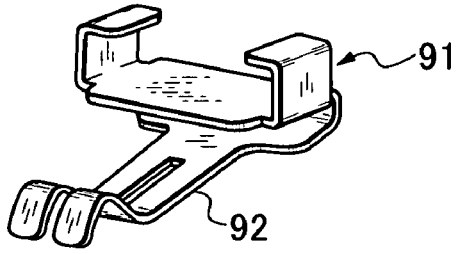
FIG. 21 is a perspective view of the auxiliary brush of the trigger switch.
Figure 22:
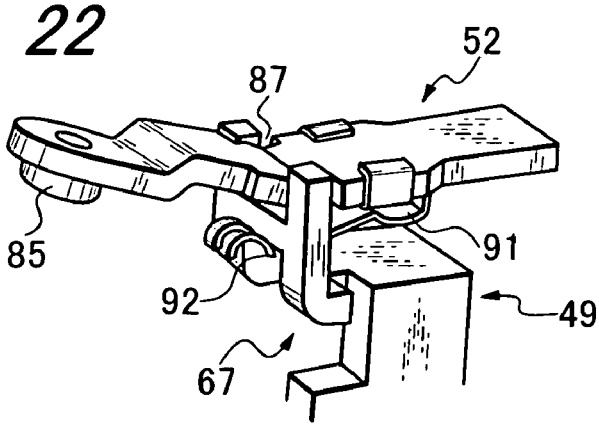
FIG. 22 is a perspective view of the trigger switch, showing the manner in which the second movable contact element is engaged on its support portion.

As shown in FIGS. 3, 13, and 14, the control device-shorting portion 39 activates the contact by causing the sliding knob 38 to slide on the second movable contact element 52 in the same way as the sliding knob 41 of the power-supply control portion 42. As shown in FIGS. 19-22, the second movable contact element 52 is made of an elongated conductive plate member. A movable contact 85 for electrically shorting the control device is mounted at one end of the plate member. A concave engagement portion 87 is formed at a widthwise end in a substantially intermediate position. The second movable contact element support portion 67 has a placement portion 67*a* engaged in the engagement portion 87. An auxiliary brush engagement portion 88 in which an auxiliary brush 91 is engaged is formed behind the engagement portion 87.

The auxiliary brush 91 is similar in shape to the auxiliary brush 73 mounted to the first movable contact element 51 but opposite in mounting direction. The auxiliary brush 91 is mounted to prevent the second movable contact element 52 from coming off easily when it engages the second movable contact element support portion 67. The rear surface of the second movable contact element 52 is aligned with the placement portion 67*a* of the second movable contact element support portion 67 equipped in the negative power supply terminal subassembly 49. The auxiliary brush 91 has a small spring 92 inserted in the opening portion 67*b*. The auxiliary brush 91 inhibits the second movable contact element support portion 67 and second movable contact element 52 from bounding and prevents poor contact. In an OFF state, the movable contact 85 of the second movable contact element 52 is located opposite to the second contact 63 (see FIG. 13) of the control device-shorting terminal subassembly 48 disposed in the case 13.

The second movable contact element 52 is disposed in this way. The sliding knob 38 of the sliding control device 12 is placed on the top surface of the disposed second movable contact element 52. A spring is incorporated in the sliding knob 38 and so the knob can be kept biased. That is, when the sliding knob 38 is placed on the top surface of the second movable contact element 52, the sliding knob 38 biases the top surface of the second movable contact element 52. When the sliding control device 12 is not operated, the second movable contact element 52 is pushed in by the spring. Therefore, the position of the sliding knob 38 is at the rearward end as viewed in FIG. 13 on the right side of the second movable contact element support portion 67 about which the second movable contact element 52 is seesawed. The movable contact 85 is raised and spaced from the second contact 63 (see FIG. 13).

In the control device-shorting portion 39 constructed in this way, if the sliding control device 12 is first pushed under the condition shown in FIG. 13, the sliding knob 38 of the connected control device-shorting portion 39 moves in the same direction while sliding on the top surface of the second movable contact element 52. Then, as shown in FIG. 14, if the sliding control device 12 is pushed, the sliding knob 38 passes across the position of the second movable contact element support portion 67 while sliding on the top surface of the second movable contact element 52. Consequently, the movable contact 85 moves toward the second contact 63. When the movable contact 85 makes contact with the second contact 63, the control device is electrically shorted. As a result, the motor can be rotated about 100%.

Figure 23:
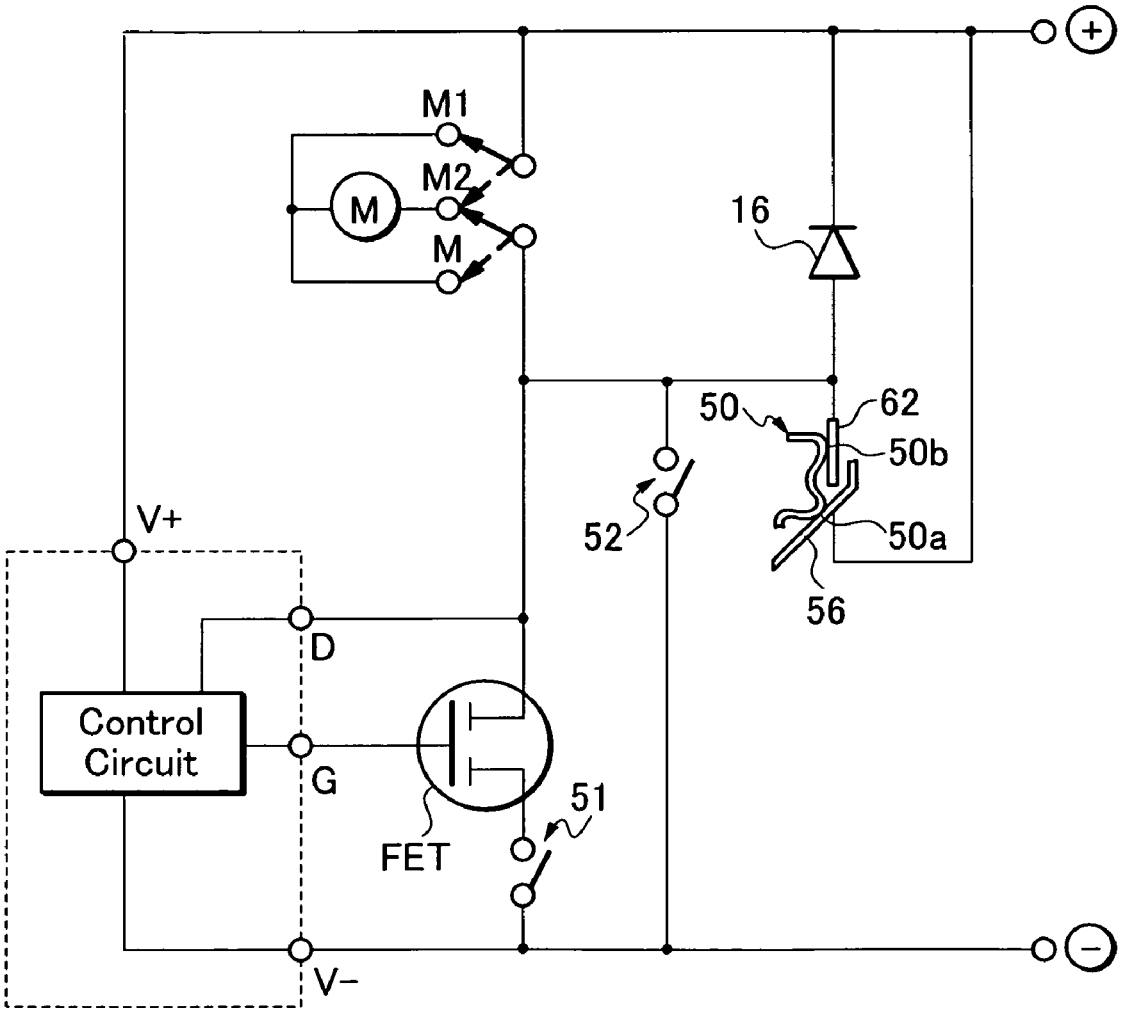
FIG. 23 is an equivalent circuit diagram of a control system in the trigger switch.

The aforementioned switch mechanism is further described by referring to the equivalent circuit shown in FIG. 23. When the trigger 11 is not manipulated, the restoring force of the return spring 44 pushes the sliding control device 12, connecting the first contact portion 50*a* and second contact portion 50*b* of the motor-shorting terminal subassembly 50 with the first shorting portion 56 and second shorting portion 62, respectively, thus electrically shorting the electrodes of the motor. Consequently, supply of electric power to the motor is cut off. When the trigger 11 is pushed in, the sliding control device 12 connected to the trigger 11 also moves. The motor-shorting terminal subassembly 50 also moves. The first contact portion 50*a* moves away from the first shorting portion 56. This permits supply of electric power to the motor. Furthermore, if the trigger 11 is pushed, the first movable contact element 51 is activated. This permits control of the control device. When the trigger is manipulated by a certain amount, the second movable contact element 52 is activated. About 100% of the power-supply voltage can be applied to the motor.

Figure 24A:
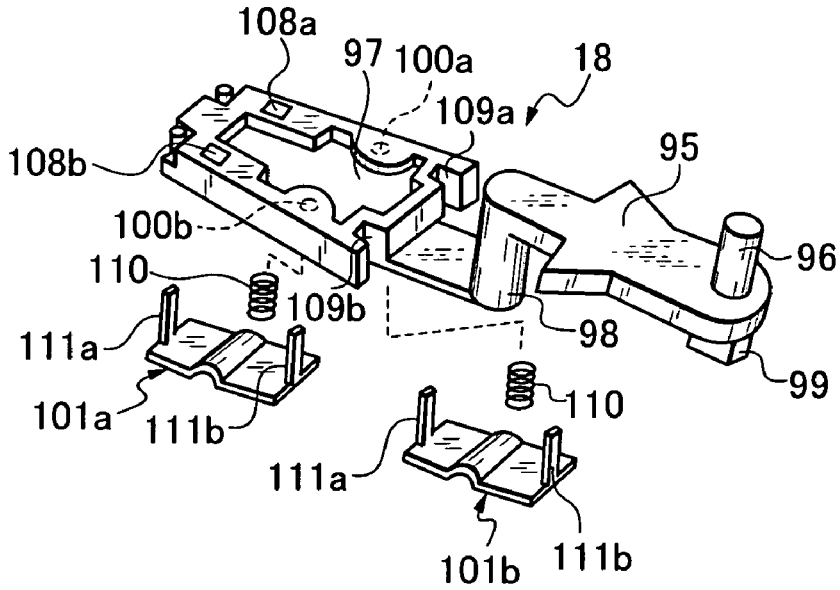
FIG. 24A is an exploded perspective view of a switching control portion of the trigger switch.
Figure 24B:
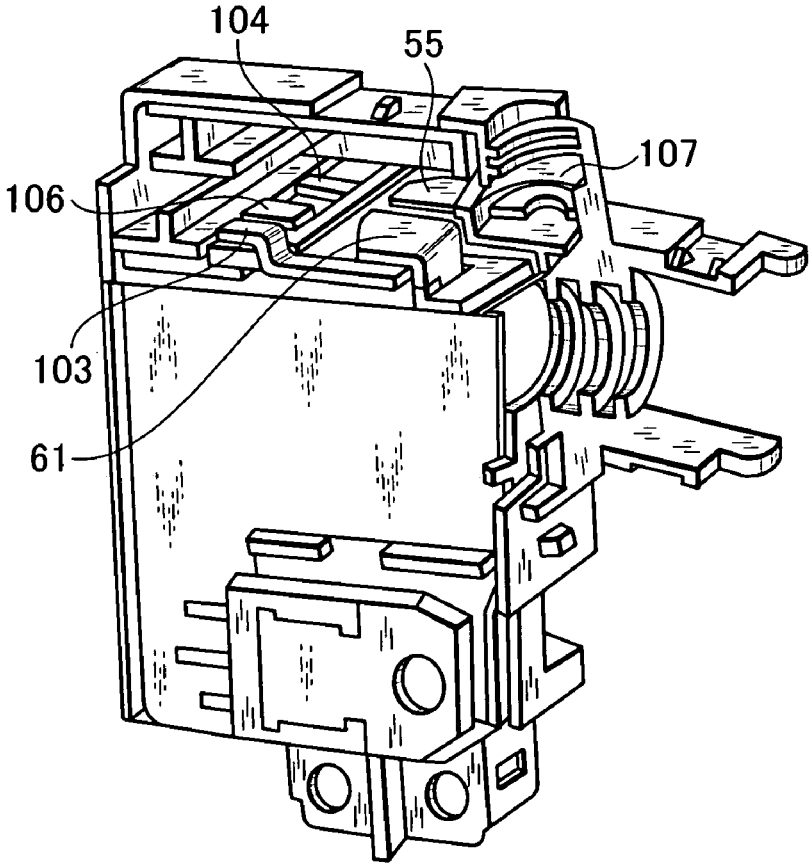
FIG. 24B is a perspective view of the case of the trigger switch.

As shown in FIGS. 24A, 246 and 3, the switching control portion 18 has a sectorially shaped lever 95 having a front-end portion from which a knob 96 protrudes. Furthermore, the switching control portion 18 has a substantially trapezoidal switching terminal portion 97 at a distance from the knob 96. The terminal portion 97 is continuous with the lever 95 but recessed a certain distance from the lever 95. In addition, the switching control portion 18 has a lever center shaft 98 protruding downward from the junction between the lever 95 and the switching terminal portion 97. A protrusive lever 99 having a round front end is mounted on the front-end side of the lever 95 and on the opposite side of the knob 96.

The switching terminal portion 97 switches the connection of the contact by causing two connection elements 101*a* and 101*b* to engage each other obliquely and rotating them. The motor is controllably rotated forward or rearward by switching the two connection elements 101*a* and 101*b* to five contacts: (1) second switching contact 61 equipped to the top portion of the control device-shorting terminal subassembly 48, (2) first switching contact 55 equipped to the top portion of the positive power supply terminal subassembly 47, (3) third switching contact 103 equipped to the first switching terminal subassembly 102, (4) fourth switching contact 104 equipped to the first switching terminal subassembly 102, and (5) fifth switching contact 106 equipped to the second switching terminal subassembly 105.

The center shaft 98 of the lever equipped at the junction between the lever 95 and the switching terminal portion 97 is engaged in the center hole 107 in the case 13 and forms the center of rotation of the switching terminal portion 97. The switching terminal portion 97 has holes 108*a*, 108*b* and grooves 109*a*, 109*b* in which the obliquely arranged connection elements 101*a* and 101*b* are engaged. Springs 110 are engaged in holes 100*a* and 100*b* formed in center positions connecting the holes 108*a*, 108*b* and grooves 109*a*, 109*b*, thus biasing the center positions of the connection elements 101*a* and 101*b* toward the contact.

The two connection elements 101*a* and 101*b* have engagement convex portions 111*a* and 111*b* fabricated by bending both elongated end portions in the same direction almost perpendicularly. The surfaces on the opposite sides of the engagement convex portions 111*a* and 111*b* form contact surfaces which make contact with the contacts (i.e., the four contacts consisting of the fourth switching contact 104, first switching contact 55, filth switching contact 106, and second switching contact 61 or the four contacts consisting of the first switching contact 55, fifth switching contact 106, third switching contact 103, and second switching contact 61). The center positions of the engagement convex portions 111*a* and 111*b* formed on both sides are biased by the springs 110. Consequently, the contact surfaces are kept pushed toward the contacts at all times.

With the switching control portion 18 constructed in this way, the connection element 101*b* is connected with the first switching contact 55 and fourth switching contact 104 by moving the knob 96 of the lever 95 with a hand in a given direction. Also, the connection element 101*a* is connected with the fifth switching contact 106 and second switching contact 61. The connection element 101*b* is connected with the first switching contact 55 and fifth switching contact 106, and the connection element 101*a* is connected with the third switching contact 103 and second switching contact 61 by moving the knob 96 in the opposite direction.

Figure 25:
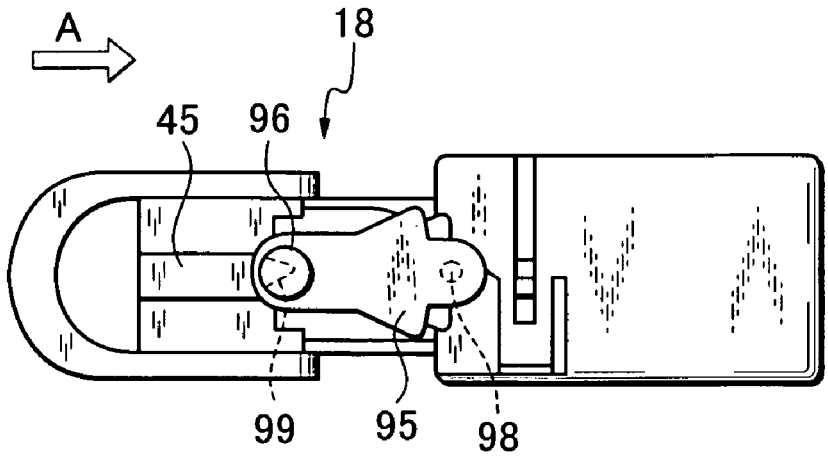
FIG. 25 is a plan view of the switching control portion.
Figure 26:
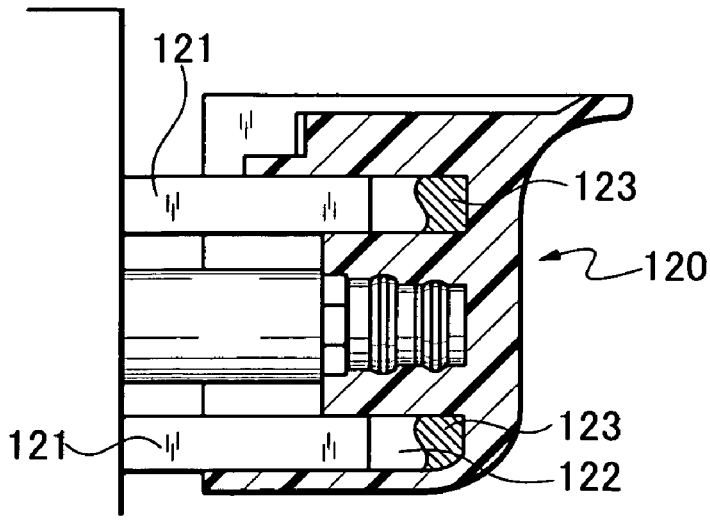
Fig. 26 PRIOR ART
FIG. 26 is a vertical cross section of the prior-art trigger switch, and in which the trigger and sliding control device have been assembled.

Referring to FIG. 25, when the lever 95 is in its neutral state, if the control portion (trigger) 11 is moved in the direction indicated by the arrow A such that the trigger is pulled in, the front end of the trigger stopper portion 45 is stopped by the protrusive lever 99. Consequently, the trigger 11 is hindered from being pulled in.

What is claimed is:

1. A trigger switch comprising:

an insulative enclosure including a case having an opening, and a cover mounted to cover the opening of the case, the case having plural terminal subassemblies made of conductive metal members disposed therein, the terminal subassemblies including at least a first terminal subassembly and a second terminal subassembly;

a fixed contact mounted in the case on the first terminal subassembly;

a movable contact element swingably supported on the second terminal subassembly and having first and second ends and front and rear surfaces, the movable contact element including a movable contact that is mounted at the first end thereof, and that is located opposite to the fixed contact;

a sliding control device slidably mounted to the insulative enclosure and having first and second ends, the sliding control device having a trigger mounted at the first end thereof; and an auxiliary brush engaged with the movable contact element and having a spring portion;

wherein the second terminal subassembly includes a support member having a placement portion and an opening portion;

wherein the movable contact element is swingably supported on the support member such that the rear surface of the movable contact element is aligned with the placement portion of the support member and such that the auxiliary brush is engaged with the opening portion of the support member by having the spring portion of the auxiliary brush inserted and mounted in the opening portion of the support member.

2. A trigger switch according to claim 1, wherein said trigger has trigger guide ribs for guiding sliding motion of the trigger, rib engagement portions in which the trigger guide ribs are inserted, and an opening portion formed in the rib engagement portions to permit dust to be expelled.

3. A trigger switch according to claim 1, wherein the insulative enclosure has formed therein a first chamber and a second chamber;

an exposed control device is disposed in the first chamber in such a manner that the control device is disposed on an outer sidewall surface of the cover that covers the opening of the case;

the fixed contact and the movable contact element are installed in the second chamber; and dustproof walls are mounted between the first and second chambers to keep out dust.

4. A trigger switch according to claim 1, wherein the opening portion of the support member is defined below the placement portion of the support member, and the movable contact element is supported swingably on the placement portion of the support member.

* * * * *